US005266932A

United States Patent [19]

Tokumitsu

[11] Patent Number: 5,266,932

[45] Date of Patent: Nov. 30, 1993

[54] VERTICAL SCROLLING ADDRESS GENERATING DEVICE

[75] Inventor: Shigenori Tokumitsu, Fukaya, Japan

[73] Assignee: Kabushiki Kaisha Toshiba, Kawasaki, Japan

[21] Appl. No.: 572,567

[22] Filed: Aug. 27, 1990

[30] Foreign Application Priority Data

Aug. 28, 1989 [JP] Japan ..... 1-220675

[51] Int. Cl.[5] ..... G09G 1/06

[52] U.S. Cl. ..... 345/123; 345/121; 345/115

[58] Field of Search ..... 340/723, 724, 726, 721, 340/734, 744, 748, 750; 358/142, 160, 22

[56] References Cited

U.S. PATENT DOCUMENTS

| | | | |
|---|---|---|---|
| 4,386,410 | 5/1983 | Pandya et al. | 340/726 X |
| 4,412,294 | 10/1983 | Watts et al. | 340/726 X |
| 4,649,377 | 3/1987 | Urabe | 340/721 |
| 4,649,379 | 3/1987 | Canton et al. | 340/748 |
| 4,694,406 | 9/1987 | Shibui et al. | 340/726 |
| 4,873,514 | 10/1989 | Nakagawa et al. | 340/726 |
| 5,065,346 | 11/1991 | Kawai et al. | 340/721 |

FOREIGN PATENT DOCUMENTS

| | | |
|---|---|---|
| 0145529 | 6/1985 | European Pat. Off. . |
| 0185293 | 6/1986 | European Pat. Off. . |
| 3206565 | 9/1982 | Fed. Rep. of Germany . |
| 3707490 | 9/1988 | Fed. Rep. of Germany . |
| 59-31715 | 8/1984 | Japan . |

OTHER PUBLICATIONS

NTT, "Technical Reference Material, Interface of Videotex Communication Network Service (Terminal Edition)", Aug. 25, 1984, pp. 73–85 and 233–234 (partial translation provided).

Hiroshi Taniike and Youji Koizumi, "Broadcasting Technology CAPTAIN System", Oct. 1984, pp. 874–888 (no translation readily available).

Kenroku Kan, "Text Broadcasting Technical Handbook Edited By Broadcasting Technology Developing Conference", Aug. 1, 1986, pp. 13–43, 233–237 and 239–243 (no translation readily available).

IBM Technical Disclosure Bulletin, "Display with Partitioned Slow Scroll", D. A. Stockwell, Sep. 1980.

*Primary Examiner*—Tommy Chin
*Assistant Examiner*—A. Au
*Attorney, Agent, or Firm*—Cushman, Darby & Cushman

[57] ABSTRACT

This invention relates to an image display system for reading out image data stored in an image memory and displaying the image data on multiple image planes and the vertical scrolling operation can be independently effected for each of the image planes displayed on the multiple image plane display basis. That is, assuming that two image planes are displayed on upper and lower areas, display starting addresses lying in the vertical direction of the upper and lower image planes and stored in registers are loaded into a counter via a switch in a display period of the upper and lower image planes to generate addresses in the vertical direction of the upper and lower image planes. The vertical scrolling operation only for one of the upper and lower image planes can be effected by sequentially updating the display starting addresses lying in the vertical direction of the upper and lower image planes and held in one of the registers.

2 Claims, 7 Drawing Sheets

VERTICAL SCROLLING ADDRESS GENERATING DEVICE

BACKGROUND OF THE INVENTION

1. Field of the Invention

This invention relates to a vertical scrolling address generating device for generating a display address in a vertical direction to effect the vertical scrolling for respective images displayed on multiple image planes in a multiple image plane display system such as a videotex system or multiplexed text broadcasting system.

2. Description of the Related Art

As is well known in the art, an information providing system which is called a videotex system (it is also called a CAPTAIN system) by which an information center and user's terminals each having a television receiver are connected to one another via telephone lines to permit the users to take out necessary information from the information center and display the same has been widely used.

The user's terminals of such a videotex system are divided into five groups of ranks 1 to 5 according to the performance thereof, and among them, the terminals of ranks 2 and 3 are most widely used. The rank-2 terminal has an image display area of 248 picture elements in a lateral direction and 204 picture elements in a vertical direction, that is, an image display area corresponding to the display plane (standard picture plane) of a television receiver of present NTSC system.

In contrast, the rank-3 terminal has an image display area of 496 picture elements in a lateral direction and 408 picture elements in a vertical direction, that is, an image display area corresponding to four standard picture planes (the image plane having picture elements of four standard picture planes is hereinafter referred to as a high density image plane). Therefore, in the rank-3 terminal of the videotex system, in a case where a standard picture image (1) is received, the picture elements can be multiplied by four times and displayed on an image display area S as shown in FIG. 1A or they can be displayed in the form of four standard picture images (1) on the image display area S as they are as shown in FIG. 1B.

The above user's terminals of the videotex system are disclosed in, for example, "Technical Reference Material, Interface of Videotex Communication Network Service (Terminal Edition)" published from NTT, pp. 73–85 and 223–234 Aug. 25, 1984, or "Broadcasting Technology CAPTAIN System" by Hiroshi Taniike and Youji Koizumi, pp. 874 to 888, October, 1984.

In a case where the standard picture image is displayed on multiple image planes in the videotex system, it is considered that the standard picture image transmitted from an information center together with "multiple image plane display" specifying information attached thereto is automatically displayed on multiple image planes according to the multiple image plane display specifying information by the user's terminal or that the standard picture image transmitted from the information center without "multiple image plane display" specifying information attached thereto is displayed on multiple image planes by the operation of the user for setting the user's terminal into the multiple image plane display mode.

In general, "vertical scroll" specifying information is not included in the standard picture image transmitted from the information center, if information designating multiple image plane display is included in the image. That is, the standard picture image having the information designating multiple image plane display provides a desired image display effect when it is displayed on the multiple image planes. Thus is because the standard picture image has contents not required to be scrolled in a vertical direction.

In contrast, when the user operates the user's terminal to selectively set the same into the multiple image plane display mode, some of a plurality of standard picture images to be displayed on the multiple image planes may be transmitted from the information center together with "vertical scroll" "multiple image plane display" specifying information attached thereto. In this case, the vertical scrolling operation must be properly effected with respect to the standard picture image transmitted from the information center together with "vertical scroll" specifying information attached thereto even if it is set in the multiple image display state.

However, since the conventional rank-3 terminal is designed mainly for processing standard picture images having "multiple image plane display" specifying information attached thereto, it is functionally impossible to separately effect the vertical scroll with respect to each of the standard picture images displayed on the multiple image planes. Therefore, in a case where the user operates the user's terminal for the multiple image plane display so as to select the multiple image plane display mode, it is impossible to effect the vertical scroll with respect to a standard picture image contained in the standard picture images displayed on the multiple image planes even if it is transmitted from the information center together with "vertical scroll" specifying information attached thereto.

That is, in a case where the user operates the user's terminal for the multiple image plane display so as to select the multiple image plane display mode, the display position (quadrant) of that standard picture image which is to be scrolled in a vertical direction may be changed according to the way the standard picture image displayed on the multiple image planes is selected or the arrangement of the standard picture images and cannot be determined, and therefore, it is impossible to separately and vertically scroll only that one of the standard picture images displayed on the multiple image planes which has "vertical scroll" specifying information attached thereto if a function of separately and vertically scrolling the standard picture images displayed on the multiple image planes is not provided for the user's terminal.

Further, the above problems occur not only in the user's terminal of the videotex system but also in level-B receivers which are one type of television receivers of the text broadcasting system, for example. The text broadcasting system is disclosed in "Text Broadcasting Technical Handbook Edited By Broadcasting Technology Developing Conference" published by Kenroku Kan, pp. 13–43, 233–237 and 239–243. Aug. 1, 1986.

SUMMARY OF THE INVENTION

This invention has been made in view of the above problems, and an object of this invention is to provide a vertical scrolling address generating device capable of independently and vertically scrolling a standard picture image which is included in a plurality of standard picture images displayed on multiple image planes and is transmitted together with "vertical scroll" specifying information attached thereto.

According to one aspect of the present invention, there is provided a vertical scrolling address generating device provided in an image display system having a function of reading out image data stored in an image memory and effecting multiple image plane display in the vertical direction of an image display area, comprising an address storing circuit for storing display starting addresses in the vertical direction at the time of reading out image data from the image memory for image display for each of a plurality of image planes to be displayed on the multiple image plane display basis; an address re-writing circuit for re-writing the display starting address stored in the address storing circuit in the vertical scrolling direction independently for each image plane at a preset timing in each of the vertical scanning periods; a counter circuit for counting a clock of one horizontal period to generate a readout address in the vertical direction so as to read out image data from the image memory for image display; a display starting address setting circuit for setting the display starting address of a corresponding one of the image planes stored in the address storing circuit into the counter circuit at a display starting timing in the vertical direction of each image plane; and a head address setting circuit for setting a head address in the vertical direction of a corresponding one of the image planes into the counter circuit at a timing at which the counter circuit outputs a final address in the vertical direction of each image plane.

Further, according to another aspect of this invention, there is provided a vertical scrolling address generating device provided in an image display system having a function of reading out image data stored in an image memory and effecting the multiple image plane display in the horizontal direction of an image display area, comprising a plurality of vertical address generating circuits provided by a number corresponding to the number of a plurality of image planes to be displayed on the multiple image plane display basis in the horizontal direction, for generating display addresses in the vertical direction for reading out image data from the image memory for image display; and a selection circuit for selecting the addresses output from the plurality of vertical address generating circuits at the boundary of each of the image planes to be displayed on the multiple image plane display basis in the horizontal direction; wherein the vertical address generating circuit includes an address storing circuit for storing display starting addresses in the vertical direction at the time of reading out image data from the image memory for image display for each of a plurality of image planes to be displayed on the multiple image plane display basis in the horizontal direction of the image display area; an address re-writing circuit for re-writing the display starting address stored in the address storing circuit in the vertical scrolling direction independently for each image plane at a preset timing in each of the vertical scanning periods; a counter circuit for counting a clock of one horizontal period to generate an address in the vertical direction; a display starting address setting circuit for setting the display starting address of a corresponding one of the image planes stored in the address storing circuit into the counter circuit at a display starting timing in the vertical direction of each image plane; and a head address setting circuit for setting a head address in the vertical direction of a corresponding one of the image planes into the counter circuit at a timing at which the counter circuit outputs a final address in the vertical direction of each image plane.

DETAILED DESCRIPTION OF THE PREFERRED EMBODIMENTS

Figure 1A:
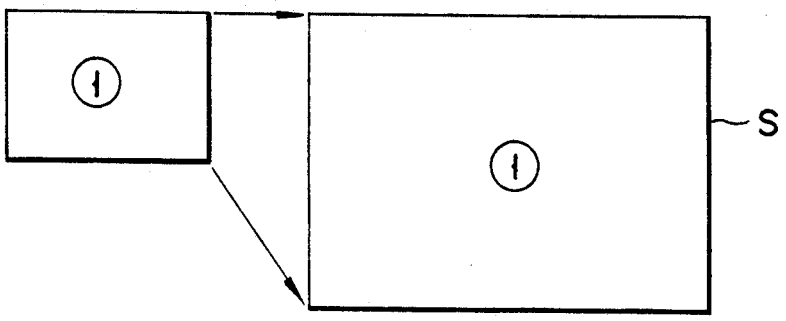
FIG. 1A (PRIOR ART)
FIGS. 1A and 1B are diagrams for illustrating the image plane display conditions in a rank-3 terminal of a videotex system.
Figure 1B:
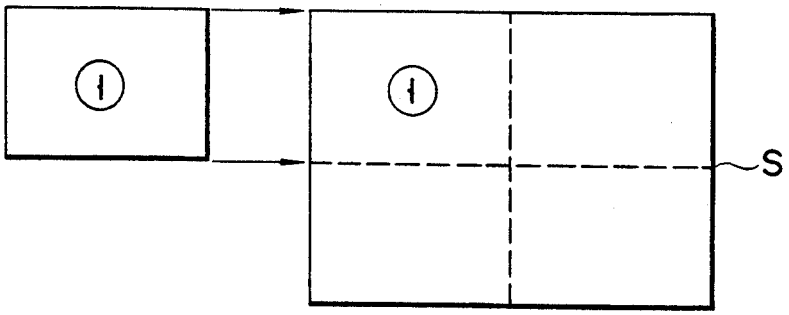
FIG. 1B (PRIOR ART)
Figure 2:
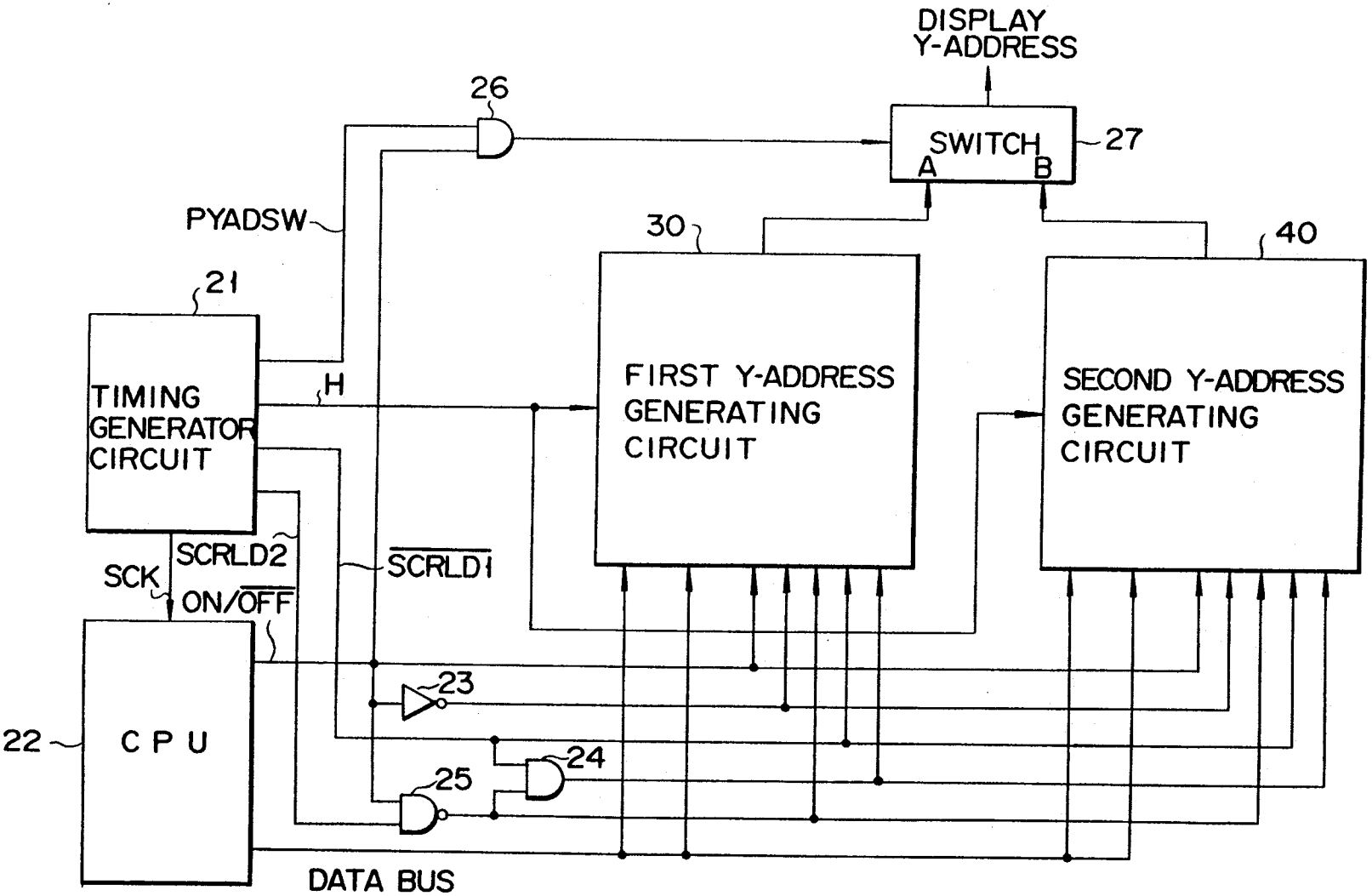
FIG. 2 is a block diagram showing the construction of one embodiment of a vertical scrolling address generating device according to this invention.

There will now be described an embodiment of this invention in detail with reference to the accompanying drawings. FIG. 2 is a block diagram showing the construction of one embodiment of a vertical scrolling address generating device according to this invention. Assuming that the user operates the rank-3 terminal of the videotex system for multiple image plane display to select the multiple image plane display mode as an typical example of the multiple image plane display operation, the description is made below. Therefore, before explaining FIG. 2, the address generating device in the rank-3 terminal of the videotex system is first explained with reference to FIG. 3.

Figure 3:
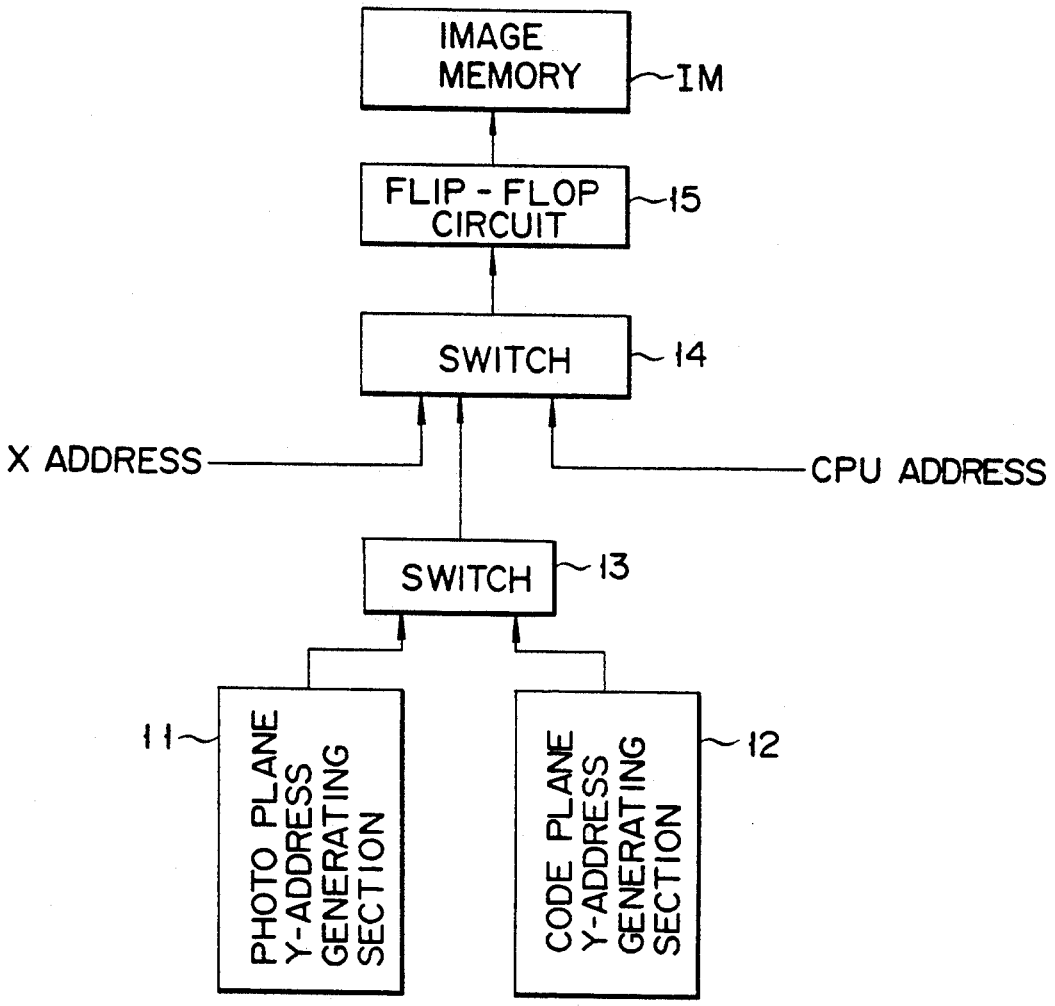
FIG. 3 is a block diagram showing the schematic construction of an address generating device in the rank-3 terminal of a videotex system.

FIG. 3 is a block diagram showing the schematic construction of the address generating device. That is, the videotex system has two independent planes which are a code plane for converting code information supplied from the information center into characters, symbols or the like by means of a character memory provided on the user's terminal side and displaying the same and a photo plane for displaying image information supplied from the information center as it is.

In FIG. 3, a reference numeral 11 denotes a Y-address generating section for the photo plane for generating an address in the vertical direction (which is referred to as a Y direction) for the photo plane. A reference numeral 12 denotes a Y-address generating section for the code plane for generating a Y-directional address for the code plane. A reference numeral 13 denotes a switch for selecting one of the Y addresses generated from the Y-address generating sections 11 and 12 according to the display timing. A reference numeral 14 denotes a switch for combining a Y-directional address derived from the switch 13 with an address in the horizontal direction (which is referred to as an X direction) which is separately supplied and selecting one of the combined address and an address supplied from a central processing unit (CPU) (not shown). A reference numeral 15 denotes a flip-flop circuit for latching an address in the image memory IM derived from the switch 14.

The address generating device of the rank-3 terminal of the videotex system is constructed as schematically described above. In the videotex system, the photo plane is vertically scrolled. Therefore, when this invention is applied to the videotex system, the vertical scrolling address generating device of this invention will be provided in the Y-address generating section 11 for the photo plane.

Now, one embodiment of the vertical scrolling address generating device of this invention which is disposed in the Y-address generating section 11 for the photo plane is explained with reference to FIG. 2. In FIG. 2, a reference numeral 30 denotes a first Y-address generating circuit for generating a Y-directional display address in the first and third quadrants, that is, a Y-directional address for reading out image data from an image memory IM (FIG. 3) for image display. Further, a reference numeral 40 denotes a second Y-address generating circuit for generating a Y-directional display address in the second and fourth quadrants.

Figure 6:
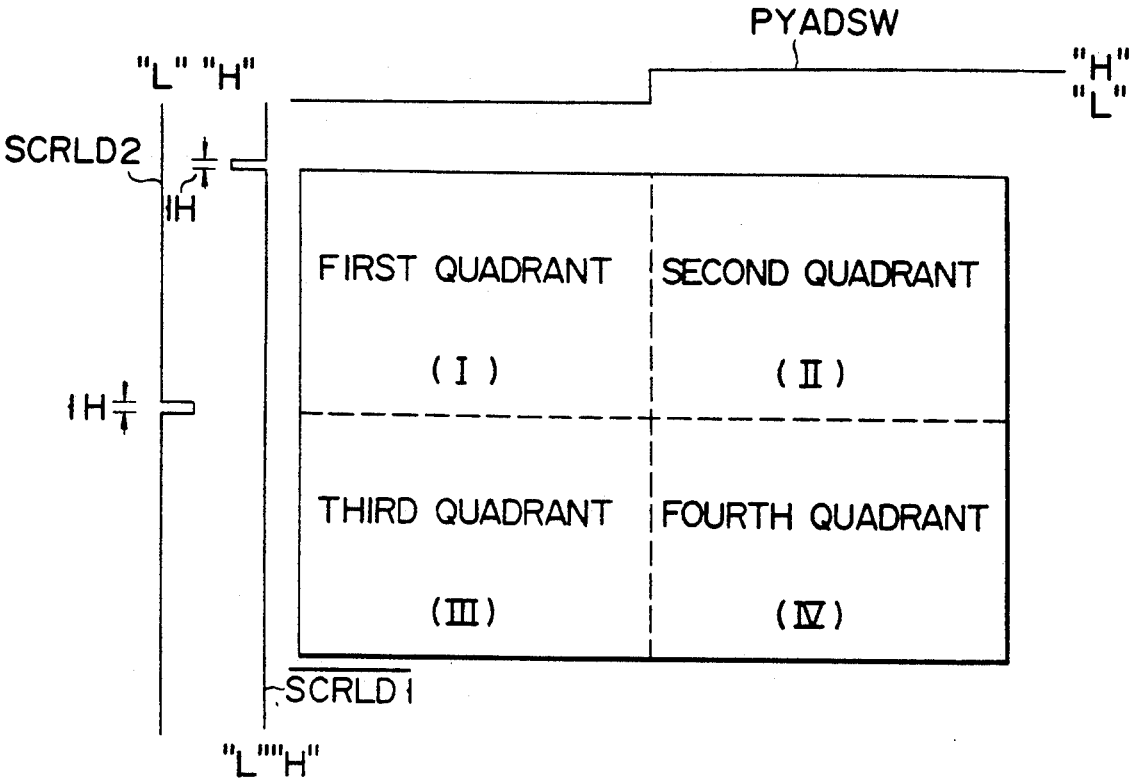
FIGS. 6 to 8 are diagrams for illustrating the operation of the embodiment shown in FIG. 2.

The positional relationship between the first to fourth quadrants is made as shown in FIG. 6. That is, the first quadrant lies in a left-upper one of four divided areas which are obtained by dividing a high-density image plane in X- and Y-directions, the second quadrant lies in a right-upper one of the four divided areas, the third quadrant lies in a left-lower one of the four divided areas and the fourth quadrant lies in a right-lower one of the four divided areas.

In FIG. 2, a reference numeral 27 denotes a switch for selecting addresses output from the first and second Y-address generating sections 30 and 40 on the boundaries between the first and third quadrants and the second and fourth quadrants. A reference numeral 26 denotes an AND circuit for creating a signal used to control the selecting operation of the switch 27. A reference numeral 21 denotes a timing generator circuit for generating various timing signals H, SCK, $\overline{\text{SCRLD1}}$, SCRLD2 and PYADSW for controlling operation of the first and second Y-address generating circuits 30 and 40 and switch 27. A reference numeral 22 denotes a CPU for outputting a mode displaying signal ON/$\overline{\text{OFF}}$ for indicating a multiple image plane display mode or non-multiple image plane display mode and a Y-directional display starting address in each of the quadrants.

Figure 4:
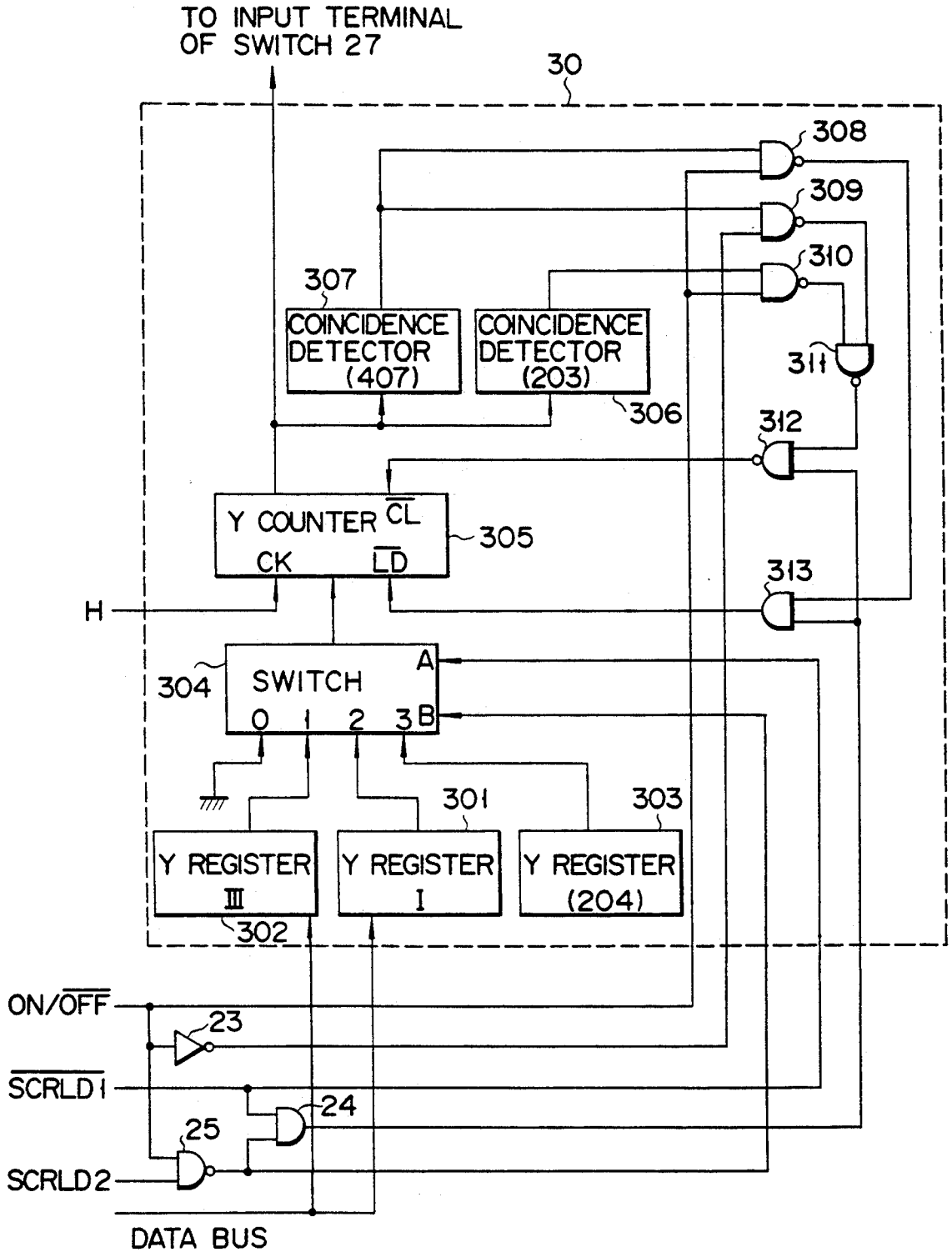
FIGS. 4 and 5 are block diagrams showing the detail constructions of main portions of the above embodiment.

The detail construction of the first Y-address generating circuit 30 is shown in FIG. 4. In FIG. 4, reference numerals 301 and 302 denote registers for holding Y-directional display starting addresses of the first and third quadrants. A reference numeral 303 denotes a register for holding a Y-directional head address (204) of the third quadrant. A reference numeral 305 denotes a counter for counting a horizontal clock H to output Y-directional addresses of the first and third quadrants. A reference numeral 304 denotes a switch for selectively supplying addresses held in the registers 301 to 303 to the counter 305. A reference numeral 306 denotes a coincidence detection circuit for detecting that an output count of the counter 305 coincides with a final address (203) in the Y direction of the first quadrant. A reference numeral 307 denotes a coincidence detection circuit for detecting that an output count of the counter 305 coincides with a final address (407) in the Y direction of the third quadrant. Reference numerals 308 to 313 denote logic circuits for controlling the loading process and clearing process of the counter 305.

Figure 5:
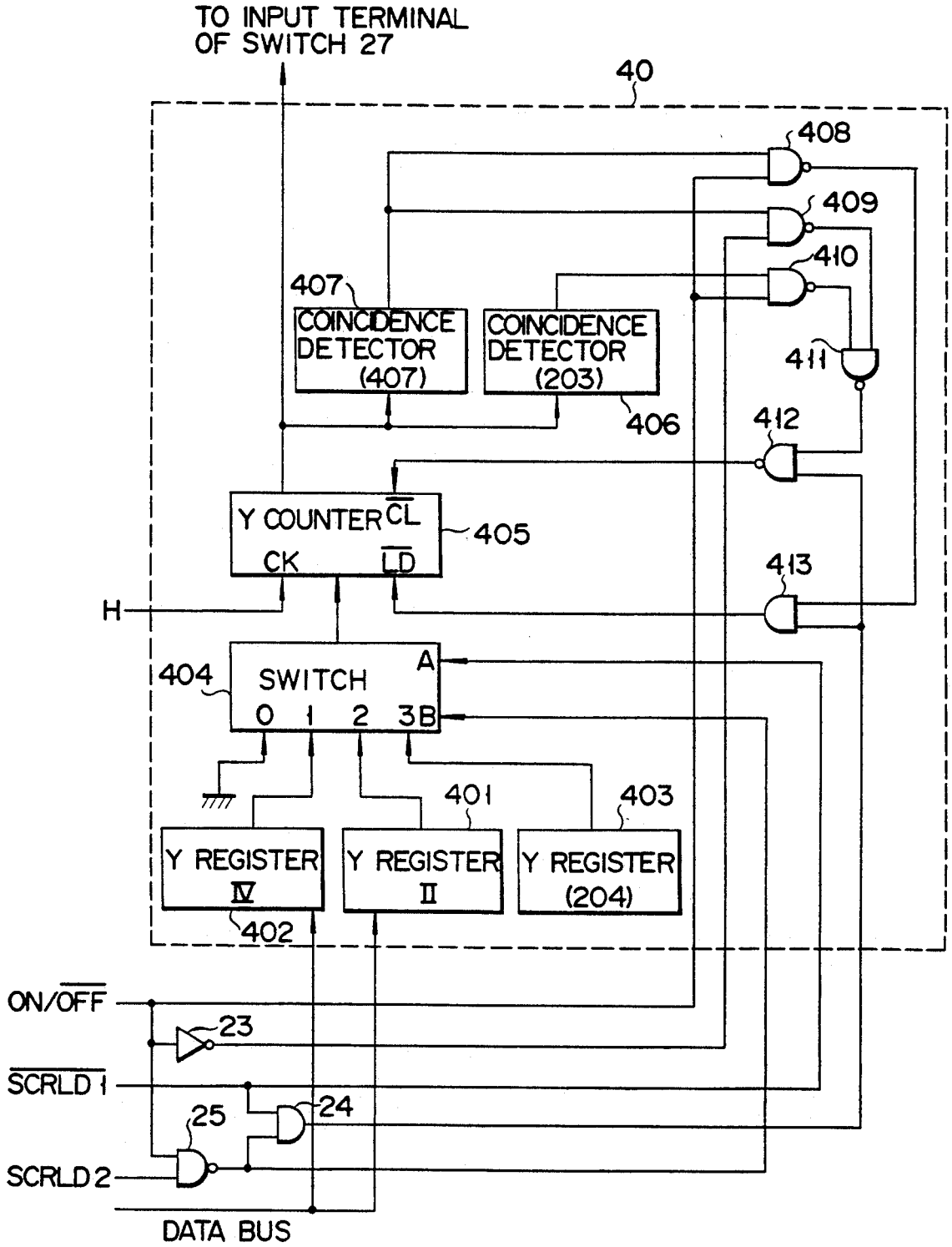

The detail construction of the second Y-address generating circuit 40 is shown in FIG. 5. The second Y-address generating circuit 40 has substantially the same construction as the first Y-address generating circuit 30, and includes registers 401 and 402 for holding Y-directional display starting addresses of the second and fourth quadrants, a register 403 for holding a Y-directional head address (204) of the fourth quadrant, a counter 405 for outputting Y-directional addresses of the second and fourth quadrants, a switch 404 for selecting addresses held in the registers 401 to 403, a coincidence detection circuit 406 for detecting that an output count of the counter 405 coincides with a final address (203) in the Y direction of the second quadrant, a coincidence detection circuit 407 for detecting that an output count of the counter 405 coincides with a final address (407) in the Y direction of the fourth quadrant, and logic circuits 408 to 413 for controlling the loading process and clearing process of the counter 405.

Further reference numerals 23 to 25 also denote logic circuits for controlling the counting operation of the counters 305 and 405.

In this example, various timing signals H, SCK, $\overline{\text{SCRLD1}}$, SCRLD2, PYADSW and ON/$\overline{\text{OFF}}$ output from the timing generator circuit 21 and CPU 22 are made as follows. First, the mode display signal ON/$\overline{\text{OFF}}$ output from the CPU 22 is set at an "H" level in the multiple image plane display mode and at an "L" level in the non-multiple image plane display mode. The horizontal clock H output from the timing generator circuit 21 is a clock of one horizontal period. The timing signal $\overline{\text{SCRLD1}}$ is a signal which is set at the "L" level only in one horizontal scanning period at the display starting timing in the first and second quadrants in synchronism with the image display operation. Likewise, the timing signal SCRLD2 is a signal which is set at the "H" level only in one horizontal scanning period at the display starting timing in the third and fourth quadrants. That is, the timing signals $\overline{\text{SCRLD1}}$ and SCRLD 2 are signals of vertical scanning period and the phases thereof are deviated by half a period (which is hereinafter referred to as ½ image display period) which is obtained by subtracting the vertical blanking period from one vertical scanning period. Further, the timing signal PYADSW is a signal of horizontal scanning period which changes from the "L" level to the "H" level in the boundaries between the first and third quadrants and the second and fourth quadrants and changes from the "H" level to the "L" level in the horizontal blanking period.

FIG. 6 shows the relation between the first to fourth quadrants and the timing signals $\overline{\text{SCRLD1}}$, SCRLD2 and PYADSW.

Figure 7:
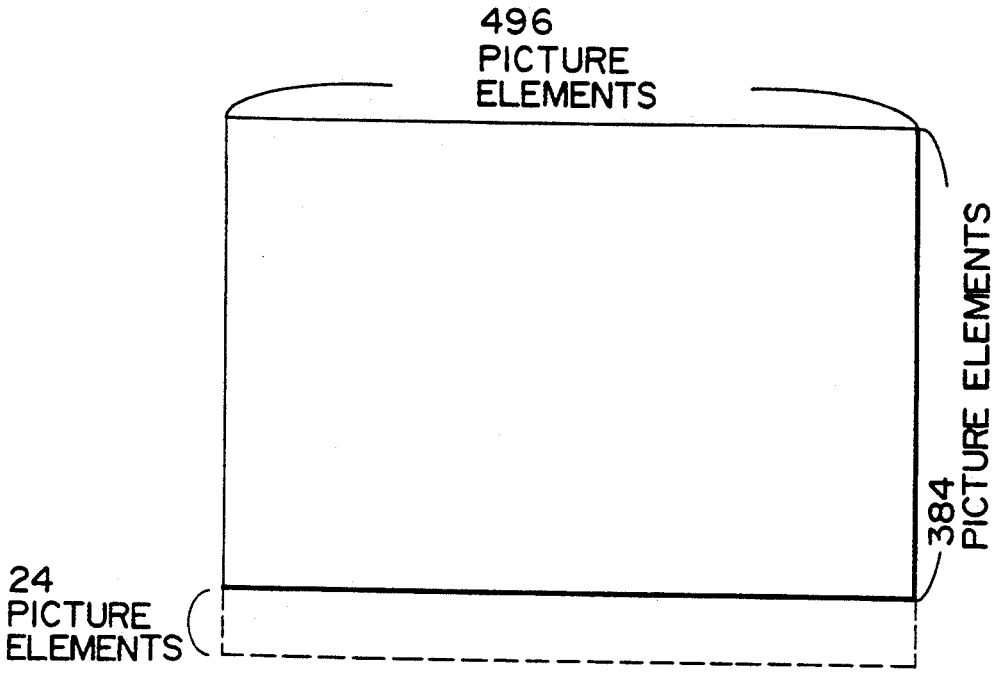

With the above construction, the operation of generating a Y address in the nonmultiple image plane display mode is first explained. The number of picture elements in the photo plane of the high-density image plane is 496 in the X direction and 408 in the Y direction as described before. Assuming that an area of 24 picture elements in the Y direction is used as a buffer area for the vertical scroll, the Y-directional addresses are 0 to 407 and 384 picture elements in the Y direction are actually used for image display as shown in FIG. 7.

The reason why the buffer area of 24 picture elements in the Y direction is provided is that the videotex uses a block coloring system which is a coloring system for coloring the picture elements for each block constituted by a plurality of picture elements in the X and Y directions. When the block coloring system is used, image data in the same coloring block may sometimes be displayed separately on the upper and lower end portions of the image plane since the vertical scroll is generally effected for each horizontal scanning line. If such a case has happened, the same color appears on the upper and lower end portions of the image plane, thus lowering the image quality. Therefore, the buffer area is provided to prevent the image data obtained from the same coloring block from being simultaneously displayed separately on the upper and lower end portions of the image plane.

Since the mode display signal ON/OFF is set to the "L" level in the nonmultiple image plane display mode, an output of the AND circuit 26 is always kept at the "L" level. At this time, the switch 27 is always set to select an address supplied from the first Y-address generating circuit 30 to the input terminal A as a display Y address. As a result, the vertical scroll is effected according to the address output from the first Y-address generating circuit 30 in the nonmultiple image plane display mode.

The address generating operation of the first Y-address generating circuit 30 is effected as follows. The display starting addresses in the Y direction of the photo plane are sequentially written into the register 301 via the data bus by mean of the CPU 22 at preset timings (for example, in the vertical period in synchronism with the image display) of each vertical scanning period. That is, the addresses from "0" to "407" are sequentially written one at a time in the scrolling direction. For example, if the scrolling direction is set in the upward direction, the addresses are sequentially written one at a time in an order from "0" to "407". If the scrolling direction is set in the downward direction, the address writing order is reversed. The following explanation is made on the assumption that the scrolling direction is set in the upward direction.

When the mode display signal ON/$\overline{\text{OFF}}$ is set at the "L" level (nonmultiple image plane display mode), an output of the NAND circuit 25 is always kept at the "H" level. The "H" level signal is supplied to the control terminal B of the switch 304. The control terminal A of the switch 304 is supplied with the timing signal $\overline{\text{SCRLDI}}$. Therefore, while the timing signal $\overline{\text{SCRLDI}}$ is set at the "L" level, the level of the control terminals A and B of the switch 304 are respectively set at the "L" and "H" levels and they are set at the "H" level in the other period.

The switch 304 selects the display starting address of the photo plane supplied from the register 301 to the input terminal 2 while the levels of the control terminals A and B are set at the "L" and "H" levels, respectively. On the other hand, it selects the head Y-address "204" of the third quadrant supplied from the register 303 to the input terminal 3 while the levels of the control terminals A and B are set at the "H" level.

The timing signal $\overline{\text{SCRLDI}}$ is supplied to the load terminal LD of the counter 305 via the AND circuits 24 and 313. As a result, the display starting address selected by the switch 304 is loaded into the counter 305 at the display starting timing of the photo plane. When the display starting address is loaded, the counter 305 increases its content one by one in synchronism with the horizontal clock H starting from the loaded address. When the counter 305 effects the count-up operation an the count thereof has reached the final address "407" of the photo plane, a coincidence detection pulse of "H" level is output from the coincidence detection circuit 307. The coincidence detection pulse is converted to an "L" level pulse by means of the NAND circuits 309, 311 and 312 and then supplied to the clear terminal $\overline{\text{CL}}$ of the counter 305 as a clear pulse.

Now, the level converting operation is explained in detail. The coincidence detection pulse output from the coincidence detection circuit 307 is supplied to one of the input terminals of the NAND circuit 309. The other input terminal of the NAND circuit 309 is supplied with the mode display signal ON/$\overline{\text{OFF}}$ which has been inverted to an "H" level signal by means of the inverter 23. Therefore, the coincidence detection pulse is converted to an "L" level pulse by the NAND circuit 309.

The coincidence detection pulse which has been converted to have the "L" level is supplied to one of the input terminals of the NAND circuit 311. The other input terminal of the NAND circuit 311 is supplied with an output of the NAND circuit 310. The NAND circuit 310 is supplied with the mode display signal ON/$\overline{\text{OFF}}$ and an output of the coincidence detection circuit 306. In this case, since the mode display signal ON/$\overline{\text{OFF}}$ is set at the "L" level, an output of the NAND circuit 310 is always kept at the "H" level. As a result, the coincidence detection pulse of "L" level output from the NAND circuit 309 is converted to an "H" level pulse by means of the NAND circuit 311.

The coincidence detection pulse which has been converted to have the "H" level is supplied to one of the input terminals of the NAND circuit 312. The other input terminal of the NAND circuit 312 is supplied with the timing signal $\overline{\text{SCRLDI}}$ output from the AND circuit 24.

The timing signal $\overline{\text{SCRLDI}}$ is set at the "H" level at the timing at which a coincidence detection pulse is output from the coincidence detection circuit 307. Thus, the coincidence detection pulse of "H" level output from the NAND circuit 311 is converted to an "L" level pulse by means of the NAND circuit 312.

When the counter 305 is cleared by the coincidence detection pulse of "L" level thus obtained, the counter 305 increases its content one by one from "0" until the timing signal $\overline{\text{SCRLDI}}$ is set to the "L" level again. Therefore, in this case, the counter 305 counts 384 in the range of "0" to "407".

When one vertical scanning period has passed after the timing signal $\overline{\text{SCRLDI}}$ was set to the "L" level, the timing signal $\overline{\text{SCRLDI}}$ is set to the "L" level again. As a result, a next display starting address held in the register 301 is loaded into the counter 305. After this, the counter 305 increases its content one by one starting from the loaded address. In this way, the same operation as described above is repeatedly effected and the photo plane will be scrolled in an upward direction by one scanning line for each vertical scanning period.

The reason why the logical product of the coincidence detection pulse and the timing signal $\overline{\text{SCRLDI}}$ is derived by means of the NAND circuit 312 is to prevent the counter 305 from being cleared at a timing at which a selected output of the switch 304 is loaded into the counter 305. That is, the timing of generating the coincidence detection pulse may happen to coincide with the timing at which the timing signal $\overline{\text{SCRLDI}}$ is set to the "L" level according to the value of the display starting address set in the register 301. Therefore, the above logical product is derived by use of the NAND circuit 312 in order to prevent the coincidence detection pulse from being supplied to the counter 305 while the timing signal $\overline{\text{SCRLDI}}$ is set at the "L" level. As a result, in the counter 305, the loading operation is effected in preference to the clearing operation.

As described above, the vertical scroll in the nonmultiple image plane display mode is effected by updating the display starting address held in the register 301 for each vertical period, loading the updated display starting address into the counter 305 at a display starting timing of the photo plane and clearing the counter 305 when the count of the counter 305 has reached "407".

Figure 8:
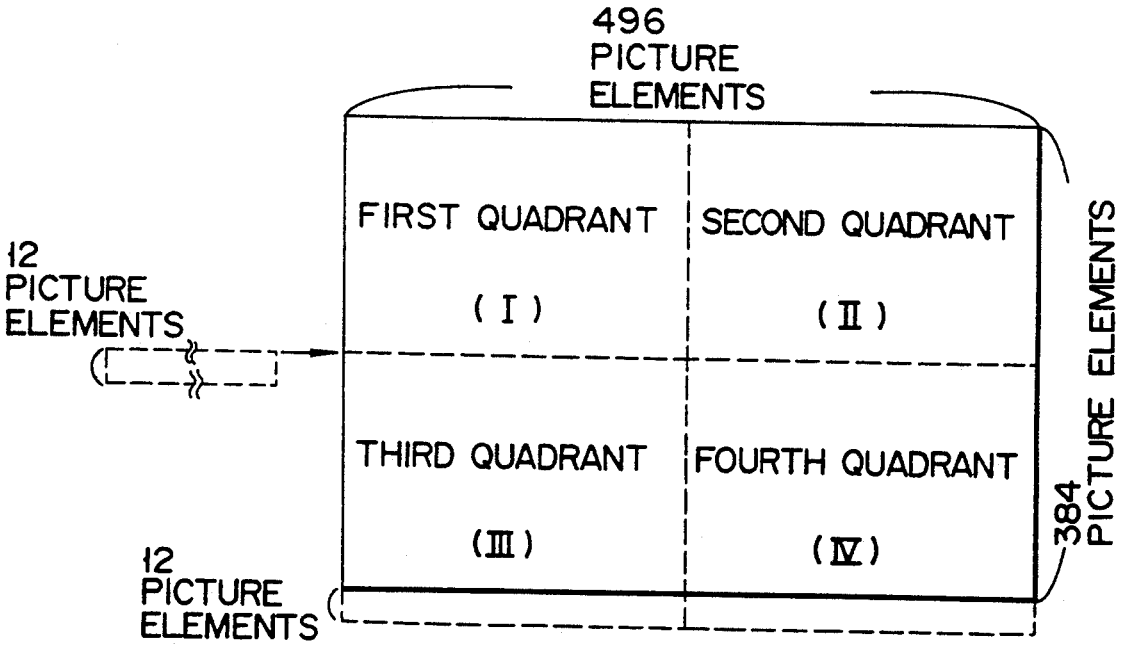

Next, the operation of generating a Y address in the multiple image plane display mode is explained. First, the vertical scrolling buffer area in the multiple image plane display mode is explained with reference FIG. 8. As described before, the number of picture elements of the high-density image plane is 496 in the X direction and 384 in the Y direction. The buffer area for the first and second quadrants is provided to have 12 picture elements between the first and second quadrants and the third and fourth quadrants. The buffer area for the third and fourth quadrants is provided to have 12 picture elements below the third and fourth quadrants. Therefore, the addresses of the first and second quadrants in the Y direction range from "0" to "203" including the buffer area, and 192 addresses among them are used for display. Likewise, the addresses of the third and fourth quadrants in the Y direction range from "204" to "407" and 192 addresses among them are used for display.

With the above address assignment, the vertical scroll is effected as follows. In the multiple image plane display mode, the mode display signal ON/$\overline{\text{OFF}}$ is set at the "H" level. Therefore, the timing signal PYADSW is supplied to the switch 27 via the AND circuit 26. Then, the switch 27 selects the address output from the first Y-address generating circuit 30 while the timing signal PYADSW is set at the "L" level, that is, in the display period of the first and third quadrants (refer to FIG. 6). In contrast, the switch 27 selects the address output from the second Y-address generating circuit 40 while the timing signal PYADSW is set at the "H" level, that is, in the display period of the second and fourth quadrants.

Therefore, in the multiple image plane display mode, the vertical scroll in the first and third quadrants is effected according to the addresses output from the first Y-address generating circuit 30, and the vertical scroll in the second and fourth quadrants i effected according to the addresses output from the second Y-address generating circuit 40.

The address generating operation of the first Y-address generating circuit 30 is effected as follows. That is, the display starting addresses in the Y direction in the first quadrant are sequentially written into the register 301 by the CPU 22 in a vertical period which is set in synchronism with image display. In other words, addresses "0" to "203" are sequentially written one by one in the scroll direction. Likewise, addresses "204" to "407" are sequentially written one by on into the register 302 in the scroll direction. In the following explanation, the scroll direction is set to the upward direction.

First, the mode display signal ON/$\overline{\text{OFF}}$ is set to the "H" level and the timing signal SCRLD2 is inverted by the NAND circuit 25 (the inverted form of SCRLD2 is hereinafter expressed as $\overline{\text{SCRLD2}}$). The timing signal $\overline{\text{SCRLD2}}$ is supplied to the control terminal B of the switch 304. The control terminal A of the switch 304 is supplied with the timing signal $\overline{\text{SCRLD1}}$ as described above.

Therefore, the levels of the control terminals A and B are respectively set to the "L" and "H" levels in a period in which the timing signal $\overline{\text{SCRLD1}}$ is set at the "L" level. At this time, the switch 304 selects the display starting address of the first quadrant supplied from the register 301 to the input terminal 2 and supplies the sam to the counter 305.

On the other hand, the levels of the control terminals A and B are respectively set to the "H" and "L" levels in a period in which the timing signal $\overline{\text{SCRLD2}}$ is set at the "L" level. At this time, the switch 304 selects the display starting address of the third quadrant supplied from the register 302 to the input terminal 1 and supplies the same to the counter 305.

In a period other than the above two periods, the levels of the control terminals A and B are each set to the "H" level. At this time, the switch 304 selects the head Y-address "204" of the third quadrant supplied from the register 303 to the input terminal 3 and supplies the same to the counter 305.

Further, the timing signals $\overline{\text{SCRLD1}}$ and $\overline{\text{SCRLD2}}$ are supplied to the load terminal $\overline{\text{LD}}$ via AND circuits 24 and 313. As a result, at the display starting timing in the first quadrant, the display starting address of the first quadrant is loaded into the counter 305. On the other hand, at the display starting timing in the third quadrant, the display starting address of the third quadrant is loaded into the counter 305.

When the display starting address of the first quadrant is loaded into the counter 305, the counter 305 increases its content one by one in synchronism with the horizontal clock H starting from the loaded address. When the counter 305 continues to effect the count-up operation and the count thereof has reached the final address "203" of the first quadrant, then a coincidence detection pulse of "H" level is output from the coincidence detection circuit 306. The coincidence detection pulse is converted into an "L" level pulse by means of the NAND circuits 310, 311 and 312 and then supplied to the clear terminal $\overline{\text{CL}}$ of the counter 305 as a clear pulse. As a result, a count output of the counter 305 is cleared to "0" at an output timing of the coincidence detection pulse from the coincidence detection circuit 306. After this, the counter 305 increases its content one by one from "0" until the timing signal $\overline{\text{SCRLD2}}$ is set to the "L" level and the counter has thus counted 192 addresses. For example, if the starting address for the first quadrant is 14, the counter counts from 14 to 203, is cleared to 0, and counts from 0 to 1. Therefore, in the range of the first quadrant, the counter 305 counts 192 addresses in the range of "0" to "203".

When ½ image period has passed after the timing signal $\overline{\text{SCRLD1}}$ was set to the "L" level (during this period, the counter 305 has counted 191 horizontal clocks H, that is, it outputs addresses of the number corresponding to the number of picture elements in the Y direction of the first quadrant), the timing signal $\overline{\text{SCRLD2}}$ is set to the "L" level. As a result, the display starting address in the third quadrant is loaded into the counter 305. After this, the counter 305 increases its content one by one from the display starting address of the third quadrant in synchronism with the horizontal clock H.

When the counter 305 continues the count-up operation and the count has reached the final address "407" of the third quadrant, then a coincidence detection pulse of "H" level is output from the coincidence detection circuit 307. The coincidence detection pulse is supplied as a load pulse to the counter 305 via the NAND circuit 308 and AND circuit 313. At this time, since the levels of the control terminals A and B of the switch 304 are both set at the "H" level, the head address "204" of the third quadrant held in the register 303 is selected by means of the switch 304.

Therefore, when the coincidence detection pulse is output from the coincidence detection circuit 307, the head address "204" of the third quadrant is loaded into the counter 305. After this, the counter 305 increases its content one by one from "204" until the timing signal $\overline{SCRLD1}$ is set to the "L" level and the counter has thus counted 192 addresses. For example, in a manner similar to that for the first quadrant, if the starting address for the third quadrant is 218, the counter counts from 218 to 407, is set to the head address 204, and counts from 204 to 205. Thus, in the range of the third quadrant, the counter 305 counts 192 addresses in the range of "204" to "407".

When the timing signal $\overline{SCRLD1}$ is set to the "L" level again after the timing signal $\overline{SCRLD2}$ has been set to the "L" level, a next display starting address of the first quadrant is loaded into the counter 305 and the same operation as described above is repeatedly effected. In this case, there is no possibility that a coincidence detection pulse from the coincidence detection circuit 307 will be supplied to the counter 305 as a clear pulse. This is because a mode display signal ON/$\overline{OFF}$ which has been inverted by the inverter 23 is supplied to the NAND circuit 309 and an output of the NAND circuit 309 is kept at the "H" level.

Further, when the timing signals $\overline{SCRLD1}$ and $\overline{SCRLD2}$ are at the "L" level, the NAND circuit 312 is used so as not to clear the counter 305. That is, in the multiple image display mode, the load preference system is used.

The operation of the first Y-address generating circuit 30 has been explained. However, since the operation of the second Y-address generating circuit 40 is similar to the operation of the first Y-address generating circuit 3 except that the display starting addresses of the second and fourth quadrants are set into the registers 401 and 402, the detailed explanation thereof is omitted.

As described above, in this embodiment, the registers 301, 302, 401 and 402 for holding the display starting addresses in the Y direction of the first to fourth quadrants, the counter 305 for outputting the Y-directional addresses of the first and third quadrants, and the counter 405 for outputting the Y-directional addresses of the second and fourth quadrants are provided. Data held in each of the registers 301, 302, 401 and 402 can be updated in the scroll direction in the vertical scanning period by means of the CPU 22. Further, data held in each of the registers 301, 302, 401 and 402 is set into the counters 305 and 405 at the display starting timing in the Y direction of a corresponding one of the quadrants. In addition, when the counters 305 and 405 count the final address in the Y direction of each of the quadrants, the count is set into the head address in the Y direction of the quadrant.

With the above construction, independent scrolling operation for each quadrant can be effected. This is because data held in a corresponding one of the registers 301, 302, 401 and 402 is updated in a quadrant which is subjected to the vertical scrolling operation and data held in a corresponding one of the registers 301, 302, 401 and 402 is fixed at the head address of a quadrant which is not subjected to the vertical scrolling operation so that the vertical scrolling operation can be effected only in a quadrant in which data held in the register is updated.

Therefore, in the rank-3 terminal of the videotex system, if a standard image having "vertical scrolling operation" specifying information attached thereto is transmitted from the information center in a case where the user operates the user's terminal for the multiple image plane display so as to select the multiple image plane display mode, the standard image can be scrolled in the vertical direction.

Further, with a simple hardware construction, four quadrants can be independently scrolled. This is because one of the four registers 301, 302, 401 and 402 and one of two counters 305 and 405 can also be used in the nonmultiple display mode and the numbers of registers and counters exclusively used for the multiple image plane display mode are 3 and 1, respectively. Further, the loading process and clearing process for the counters 305 and 405 can be attained by a control circuit with a simple construction.

The first and second Y-address generating circuits 30 and 40 can be realized by exactly the same circuits. This is because the four quadrants are divided into two groups in the Y direction and the first and second Y-address generating circuits 30 and 40 are constructed for the divided groups.

Further, a smooth vertical scrolling operation can be effected. This is because the Y-address is generated according to the counting operation of the counters 305 and 405. The independent vertical scrolling operation for each quadrant can be effected by rewriting image data according to the software. However, in this case, a smooth vertical scrolling operation cannot be attained.

One embodiment of this invention has been described above, but this invention is not limited to the above embodiment. For example, in the above embodiment, this invention is applied to a case wherein the scrolling operation is separately effected when the user operates the user's terminal for the multiple image plane display so as to select the multiple image plane display mode in the rank-3 terminal of the videotex system, but this invention can be applied not only to the above case but also to a case wherein the scroll operation is separately effected when the multiple image plane display operation is effected.

Further, in the above embodiment, this invention is applied to a case wherein the independent scrolling operation is effected when the multiple image plane display operation is effected in the X and Y directions. However, this invention can also be applied to a case wherein the independent scrolling operation is effected when the multiple image plane display operation is effected only in the Y direction. In this case, only one of the first and second Y-address generating circuits 30 and 40 shown in FIG. 2 may be used.

Further, this invention can be variously modified without departing from the technical scope thereof.

What is claimed is:

1. A vertical scrolling address generating device provided in an image display system having a function of reading out image data stored in an image memory and effecting a multiple image plane display in horizontal and vertical directions of an image display area, comprising:

a plurality of vertical address generating means, corresponding to an amount of a plurality of image planes to be displayed on the multiple image plane display basis in the horizontal direction, for generating display addresses in the vertical direction for reading out image data from said image memory for said image display, each of said vertical address generating means comprising:

address storing means for storing, in a manner representative of the vertical direction, display starting addresses for each of a plurality of image planes to be displayed on the multiple image plane display basis in the horizontal and vertical directions of the image display area;

address re-writing means for replacing the display starting address stored in said address storing means with another one of the display starting addresses, in a manner representative of the vertical direction, independently for each of the image planes at a preset time in each of a plurality of vertical scanning periods;

counter means for counting clock pulses to generate said display addresses in a manner corresponding to the vertical direction to read out portions of said image data from said image memory for said image display;

display starting address means for setting one of the display starting addresses of each corresponding one of the image planes stored in said address storing means into said counter means at a vertical display start time of said each corresponding one of the image planes, said counter means generating a plurality of said display addresses based on said one of the display starting addresses of each corresponding one of the image planes; and head address setting means for setting a head address in the vertical direction of one of said corresponding one of the image planes into said counter means at a time when said counter means generates a predetermined one of said display addresses in the vertical direction of said one of said corresponding image planes; and selection means for selecting the display addresses output from said plurality of vertical address generating means at a boundary of each of the image planes to be displayed on the multiple image plane display basis in the horizontal direction.

2. A vertical scrolling address generating device according to claim 1, further comprising means for providing a buffer area comprising a plurality of picture elements at one end of each of the image planes displayed on the multiple image plane display basis in the vertical direction.

* * * * *